US011745913B1

(12) United States Patent
Spence

(10) Patent No.: US 11,745,913 B1
(45) Date of Patent: Sep. 5, 2023

(54) MULTI-COMPARTMENT LIQUID BEVERAGE CONTAINER ASSEMBLY

(71) Applicant: Peter Spence, North Lauderdale, FL (US)

(72) Inventor: Peter Spence, North Lauderdale, FL (US)

( * ) Notice: Subject to any disclaimer, the term of this patent is extended or adjusted under 35 U.S.C. 154(b) by 0 days.

(21) Appl. No.: 17/163,462

(22) Filed: Jan. 31, 2021

Related U.S. Application Data

(60) Provisional application No. 63/091,241, filed on Oct. 13, 2020.

(51) Int. Cl.
*B65D 8/00* (2006.01)
*B65D 41/04* (2006.01)
*B65D 23/04* (2006.01)

(52) U.S. Cl.
CPC ..... *B65D 11/04* (2013.01); *B65D 23/04* (2013.01); *B65D 41/04* (2013.01)

(58) Field of Classification Search
CPC ..... B65D 1/04; B65D 21/0233; B65D 21/02; B65D 11/04; B65D 23/04; B65D 41/04; B65D 81/3283; B65D 83/68; B65D 83/682; A61J 1/202; A61J 1/2024; A61J 1/2027; A61J 1/2093; B05B 7/0408; B05B 11/0081; B67D 1/0046
USPC .... 215/6, 10, 12.1; 220/23.88, 23.87, 23.83; 222/145.1, 145.5
See application file for complete search history.

(56) References Cited

U.S. PATENT DOCUMENTS 3,045,925 A * 7/1962 Giangualano ..... B65D 83/682 222/129
3,236,418 A * 2/1966 Dalle ..... B65D 83/682 222/394
3,269,389 A * 8/1966 Meurer ..... B05B 11/048 128/200.14
3,269,605 A * 8/1966 Silver ..... B65D 83/68 222/394
3,450,254 A * 6/1969 Miles ..... B65D 23/02 29/523
3,489,306 A * 1/1970 Bubb ..... B65D 51/2864 215/DIG. 8
3,521,792 A * 7/1970 Davidson ..... B65D 83/68 239/304
3,992,003 A * 11/1976 Visceglia ..... B65D 83/62 222/386.5
4,393,975 A * 7/1983 Moore ..... A45D 40/00 206/385
4,429,786 A * 2/1984 Hucal ..... A45C 11/005 220/4.27
4,756,424 A * 7/1988 Schwartz ..... A47J 31/02 206/217
4,951,482 A * 8/1990 Gilbert ..... F25D 3/08 62/306

(Continued)

*Primary Examiner* — King M Chu
*Assistant Examiner* — Prince Pal
(74) *Attorney, Agent, or Firm* — GLENN E. GOLD, P.A.; Glenn E. Gold

(57) ABSTRACT

A multi-compartment liquid beverage container assembly includes an outer container body housing multiple interior liquid beverage storage vessels. A one-piece liquid transfer rod contained within the outer container body releasably attaches to the interior beverage storage vessels in a manner enabling stored liquid beverage to be transferred from the interior beverage storage vessels, through the liquid transfer rod, to outer container body openings.

12 Claims, 6 Drawing Sheets

(56) References Cited

U.S. PATENT DOCUMENTS 4,988,017 A * 1/1991 Schrader ..... B65D 83/42 141/20
5,085,330 A * 2/1992 Paulin ..... A47J 43/27 426/115
5,099,232 A * 3/1992 Howes ..... B65D 81/3216 206/217
5,197,602 A * 3/1993 Biesecker ..... B65D 77/0493 206/499
5,272,890 A * 12/1993 Penxa ..... F25D 31/007 62/372
5,593,028 A * 1/1997 Haber ..... B65D 25/085 604/203
5,987,913 A * 11/1999 Andrzejczak ..... A47G 19/02 62/457.2
6,247,617 B1 * 6/2001 Clyde ..... B65D 1/0238 222/541.9
6,308,863 B1 * 10/2001 Harman ..... B65D 83/68 239/304
6,736,288 B1 * 5/2004 Green ..... B65D 83/682 222/402.19
7,194,951 B1 * 3/2007 Porter ..... A47J 31/44 99/287
7,891,199 B2 * 2/2011 Anthony ..... F25D 3/107 62/77
8,307,755 B2 * 11/2012 Shen ..... A47J 31/005 220/709
8,596,480 B2 * 12/2013 Arjomand ..... B65D 7/22 220/4.27
9,296,550 B2 * 3/2016 Smith ..... B65D 83/32
9,516,974 B2 * 12/2016 Herling ..... A47J 31/20
9,950,827 B1 * 4/2018 Lau ..... B65D 51/1644
10,588,820 B2 * 3/2020 Wengreen ..... A61M 5/002
10,889,482 B1 * 1/2021 Maclean ..... A47J 43/27
2004/0029264 A1 * 2/2004 Robbins, Jr. ..... C12M 27/12 435/291.6
2004/0155062 A1 * 8/2004 McCurry ..... B65D 81/3288 222/145.5
2005/0066682 A1 * 3/2005 Anthony ..... F25D 3/107 62/293
2005/0183587 A1 * 8/2005 Chia Salido ..... A61J 1/2093 99/483
2006/0049278 A1 * 3/2006 Hoshino ..... B65D 83/682 239/333
2006/0065674 A1 * 3/2006 Lasserre ..... B65D 83/68 222/137
2006/0151496 A1 * 7/2006 Healy ..... B65D 81/3283 220/23.83
2007/0033959 A1 * 2/2007 Anthony ..... F25D 3/107 62/294
2007/0108231 A1 * 5/2007 Gray ..... B01F 33/50111 222/145.6
2009/0188884 A1 * 7/2009 Nelson ..... A61J 9/008 215/6
2009/0272747 A1 * 11/2009 Kalaouze, Jr. ..... B65D 81/3222 220/500
2010/0025350 A1 * 2/2010 Kenney ..... B65D 81/3222 215/6
2011/0204048 A1 * 8/2011 Carino ..... B65D 21/083 220/4.03
2011/0210126 A1 * 9/2011 Vovan ..... A47G 19/06 220/574
2012/0031869 A1 * 2/2012 Bauer ..... B29C 49/071 264/573
2012/0031925 A1 * 2/2012 Greenberg ..... B05B 12/1409 222/144.5
2013/0168413 A1 * 7/2013 Bodet ..... B65D 83/64 141/2
2014/0014687 A1 * 1/2014 Cornwell ..... B65D 83/62 141/3
2015/0008241 A1 * 1/2015 Kenworthy ..... B65D 47/245 222/129
2015/0090711 A1 * 4/2015 Peterson ..... A61J 9/0638 220/4.07
2016/0046421 A1 * 2/2016 Brown ..... B65D 47/06 222/545
2016/0200486 A1 * 7/2016 Meyers ..... B65D 47/06 215/229
2016/0271015 A1 * 9/2016 Wengreen ..... A61J 1/165
2016/0272368 A1 * 9/2016 Buck, III ..... B05B 11/1083
2018/0334286 A1 * 11/2018 Yahalom ..... B65D 1/0246
2019/0152679 A1 * 5/2019 Park ..... B65D 47/00
2019/0343310 A1 * 11/2019 Rodriguez ..... B65D 81/3283
2020/0148442 A1 * 5/2020 Afif ..... A61J 1/03
2020/0391928 A1 * 12/2020 Willis ..... B65B 7/28
2021/0005337 A1 * 1/2021 Kamen ..... G21F 7/00
2021/0009336 A1 * 1/2021 Bartolucci ..... B05B 11/1084

* cited by examiner

MULTI-COMPARTMENT LIQUID BEVERAGE CONTAINER ASSEMBLY

CROSS-REFERENCE TO RELATED APPLICATION

This U.S. non-provisional patent application claims the benefit of U.S. provisional patent application No. 63/091,241 filed on Oct. 13, 2020, the entire contents of which are incorporated-by-reference herein.

FIELD OF THE INVENTION

This invention generally relates to liquid container assemblies. More particularly, the invention pertains to multi-compartment beverage container assemblies.

BACKGROUND OF THE INVENTION

Various types of multi-compartment beverage containers are known. Most such containers incorporate a partitioned container body defining independent partitioned interior container spaces for holding different respective beverages and the like. Typically, individual compartment beverages can be independently dispensed through a corresponding aperture in communication with the respective partitioned interior container space.

What is desired is a multi-compartment beverage container assembly incorporating multiple removable independent interior liquid beverage containers that provide the same functionality as container bodies with integrally formed beverage compartments.

SUMMARY OF THE INVENTION

The present invention addresses the well-established need for a multi-compartment liquid beverage container assembly, or system, that overcomes the aforementioned limitations, drawbacks, and disadvantages of the known art by providing a multi-compartment liquid beverage container assembly in which multiple reusable liquid beverage storage vessels—each containing independent volumes of liquid beverage—may be selectively inserted into, and removed from, an outer container body, or skin, in such a manner that a user may selectively pour liquid beverage, simultaneously, from one or more of the liquid beverage storage vessels.

In accordance with at least one broad implementation, the multi-compartment liquid beverage container assembly may include:

an outer container body;

a plurality of interior liquid beverage storage vessels contained within, but selectively-removable from, the outer container body;

a liquid transfer rod contained within the outer container body, the unitary liquid transfer rod releasably attached to the plurality of interior beverage storage vessels in a manner enabling the transfer of liquid beverage from the plurality of interior liquid beverage storage vessels to the unitary liquid transfer rod; and a closure cap releasably attachable to a lower end of the outer container body.

In some embodiments, the outer container body may comprise a main body transitioning, via a shoulder, to an outer container body neck, wherein: the main body is in the form of a continuous sidewall extending between a main body lower edge and the shoulder to define a main body interior space; the outer container body neck is in the form of a continuous sidewall extending between a container body neck top wall and the shoulder; the outer container body neck defines an outer container body neck interior space; and the container body neck top wall has a plurality of openings through which liquid beverage stored in the interior liquid beverage storage vessels may be poured.

In some embodiments, the unitary liquid transfer rod may comprise:

a thickened upper end extending vertically between upper and lower surfaces thereof, the thickened upper end having a plurality of liquid transfer channels extending completely therethrough, each one of the plurality of liquid transfer channels extending between an upper opening in the upper surface of the thickened upper end and a lower opening in the lower surface of the thickened upper end, the plurality of liquid transfer channels in alignment with the plurality of container body neck top wall apertures when the multi-compartment liquid beverage container assembly is in a fully-assembled state; and a stem length depending downwardly from the lower surface of the thickened upper end along a central axis of the unitary liquid transfer rod, wherein the thickened upper end of the unitary liquid transfer rod has a geometry and size conforming to the outer container body neck interior space.

In accordance with an aspect of the present invention, the unitary liquid transfer rod may further incorporate an upper half of a first frictional coupling system in the form of a raised annular wall projecting downwardly from the lower surface of the thickened upper end and surrounding the lower opening in the lower surface of the thickened upper end.

In some embodiments, each one of the plurality of interior liquid beverage storage vessels may have a geometry defined by:

a left sidewall;

a right sidewall;

an upper end wall;

a lower end wall;

an exterior radial wall spanning rear edges of the respective left sidewall, right sidewall, upper end wall and lower end wall; and a concave interior linear groove spanning front edges of the respective left sidewall, right sidewall, upper end wall and lower end wall, wherein the left and right sidewalls, the upper and lower end walls, the exterior radial wall and the concave interior linear groove, together, define an interior space of each one of the interior liquid beverage storage vessels.

In accordance with another aspect, each one of the plurality of interior liquid beverage storage vessels may incorporate an opening through the upper end wall for enabling the flow of liquid beverage therethrough.

In accordance with another aspect, each one of the interior liquid beverage storage vessels may incorporate a lower half of the first frictional coupling system in the form of a raised annular wall projecting upwardly from an upper surface of the upper end wall and surrounding the opening in the upper end wall, wherein the upper and lower halves of the first frictional coupling system enable releasable frictional attachment of the thickened upper end of the unitary liquid transfer rod to the plurality of interior beverage storage vessels in a manner enabling communication, or transfer, of liquid beverages from each one of the interior beverage storage vessels into respective ones of the plurality of liquid transfer channels.

In accordance with another aspect, the plurality of interior liquid beverage storage vessels may have a unique common geometry such that, when they are urged together (e.g. just prior to being frictionally attached to the thickened upper end of the liquid transfer rod, and prior to being inserted into the outer container body) they form, or are defined by, a combined geometry and size conforming to the main body interior space of the outer container body.

In accordance with another aspect, when the plurality of interior liquid beverage storage vessels are urged together their respective concave interior linear grooves may come together to define a channel, along a central axis of the multi-compartment liquid beverage container assembly, for receiving the lower stem length of the liquid transfer rod.

In accordance with another aspect, the closure cap may have a thickness adequate to engage, or make contact with, the lower end walls of the plurality of unitary liquid beverage storage vessels as the closure cap is threadingly attached to the lower end of the outer container body. In this manner, the upper end walls of the plurality of unitary liquid beverage storage vessels are urged against an interior surface of the outer container body shoulder and, concurrently, an upper surface of the thickened upper end of the unitary liquid transfer rod is urged against an interior surface of the top wall of the outer container bottle neck.

In accordance with another aspect, the container body neck top wall may have closure tabs attached thereto via living hinges, wherein the closure tabs are configured and positioned to selectively seal the container body neck top wall apertures. In this manner, a user may selectively pour liquid beverage from one or more of the interior liquid beverage storage vessels from the multi-compartment liquid beverage container assembly.

In accordance with another aspect, the multi-compartment liquid beverage container assembly may include an auxiliary neck sleeve configured for threading engagement with corresponding threads on an exterior surface of the continuous sidewall of the outer container body neck. The auxiliary neck sleeve may function as a mouth through which a user may drink, wherein individual streams of liquid beverage emitted from respective interior liquid beverage storage vessels are combined and poured through the common auxiliary neck sleeve during the act of drinking.

In accordance with another aspect, the incorporation of removable interior liquid beverage storage vessels in the multi-compartment liquid beverage container assembly enables the cleaning and subsequent refilling of the liquid beverage storage vessels—thereby enabling their reuse. After an individual removable interior liquid beverage storage vessel is refilled, the opening in its upper end wall may be sealed with an adhesive label for transport and storage (i.e. until it is used).

These and other aspects, features, and advantages of the present invention will become more readily apparent from the attached drawings and the detailed description of the preferred embodiments, which follow.

BRIEF DESCRIPTION OF THE DRAWINGS

The components in the drawing figures are not necessarily to scale, emphasis instead being placed upon illustrating the principles of the invention. The invention will now be described, by way of example, with reference to the accompanying drawing figures, in which.

In the accompanying figures, reference numerals designate corresponding elements throughout the different views of the drawings.

DETAILED DESCRIPTION OF EXEMPLARY EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. There is no intention to be bound by any expressed or implied theory presented in the preceding technical field, background, brief summary or the following detailed description. It is also to be understood that any specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
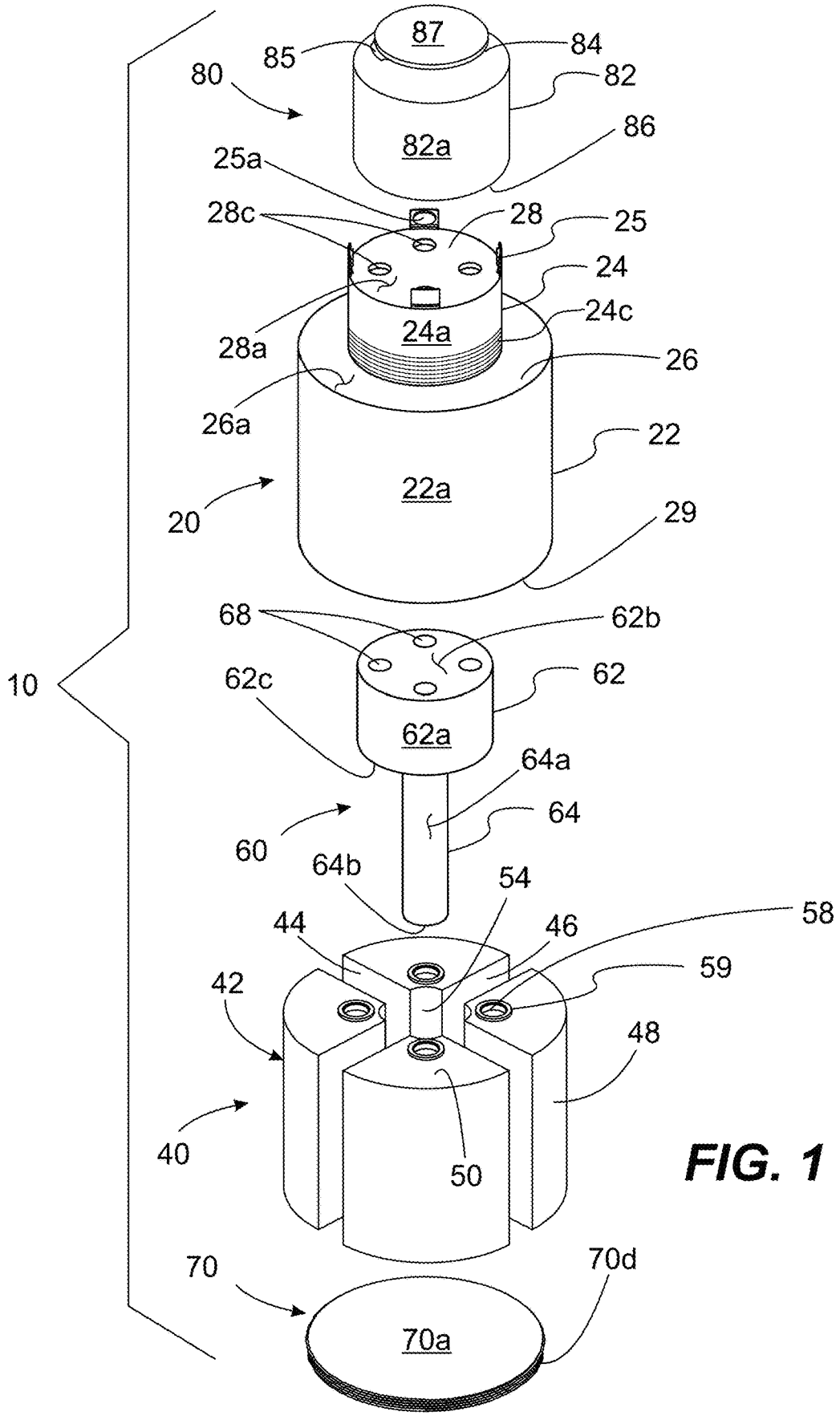
FIG. 1 is a top front exploded view of a multi-compartment beverage container subassembly 10, in accordance with an exemplary implementation of the present invention.
Figure 2:
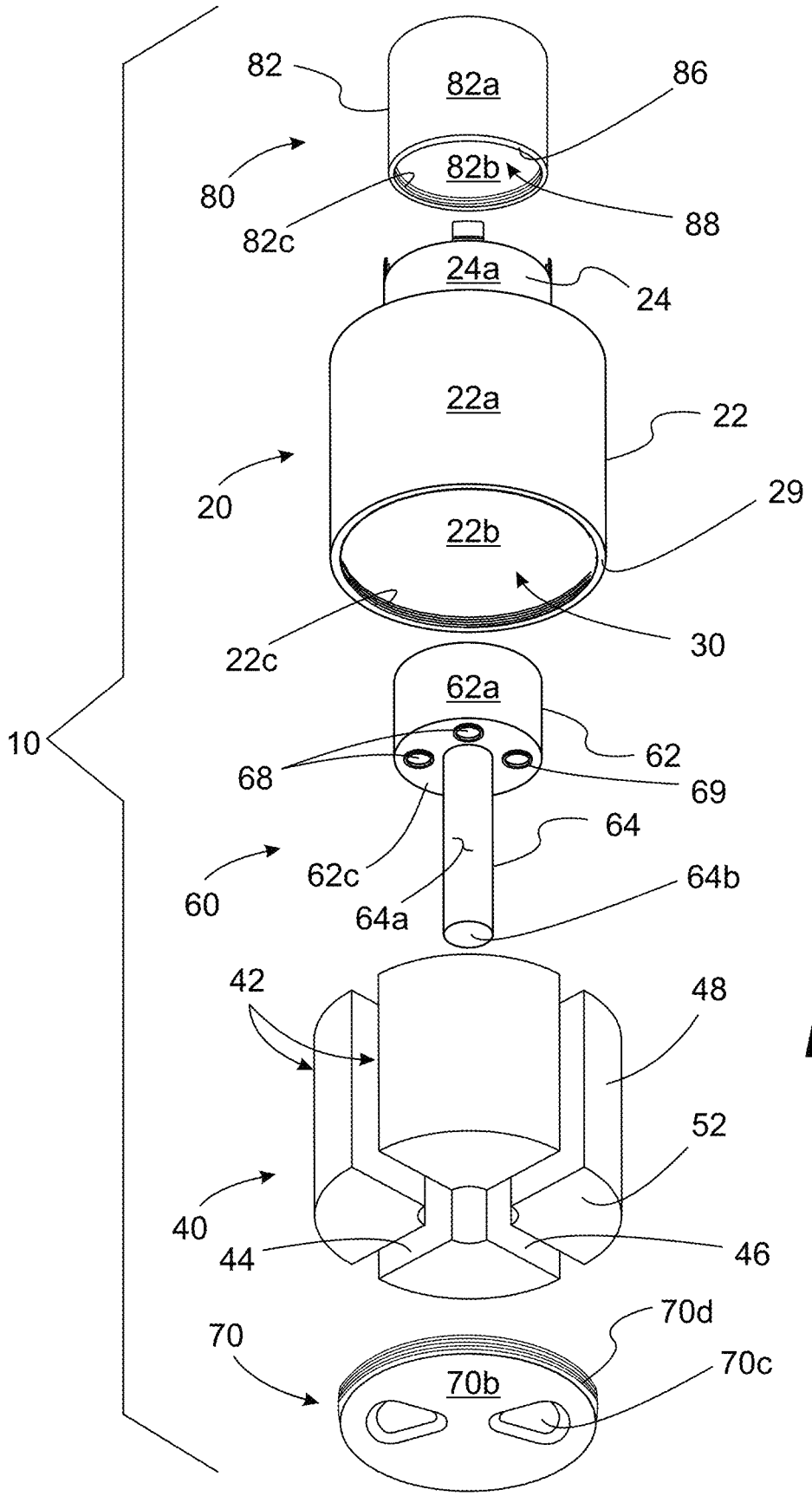
FIG. 2 is a bottom front exploded view of the multi-compartment beverage container subassembly shown in FIG. 1.
Figure 3:
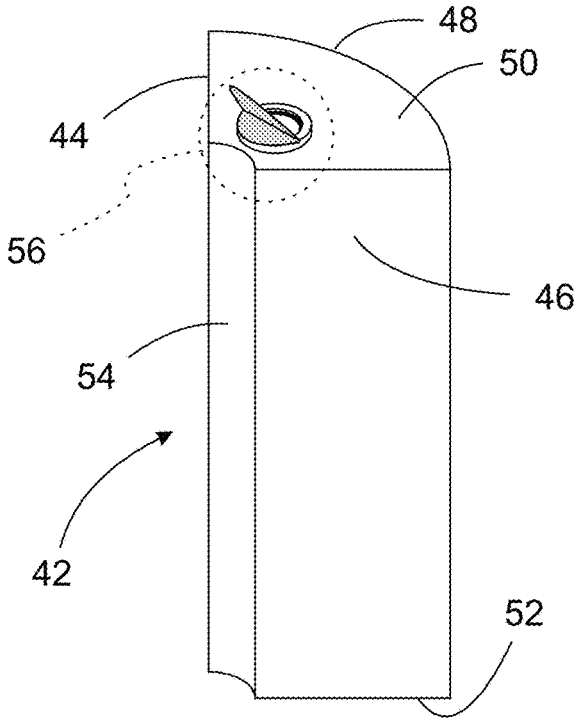
FIG. 3 is a top right perspective view of a unitary interior beverage storage vessel 42, in accordance with an exemplary implementation of the present invention.
Figure 4:
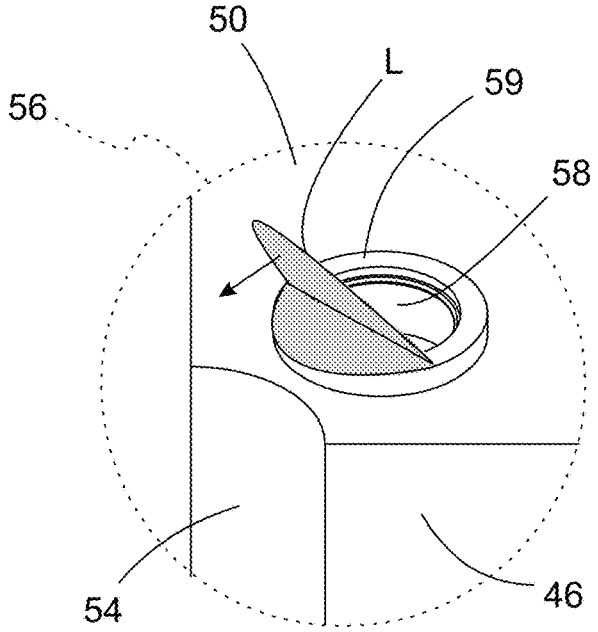
FIG. 4 is an enlarged view of a frictional attachment/engagement structure 56 of the unitary interior beverage storage vessel 42 introduced in FIG. 3.
Figure 5:
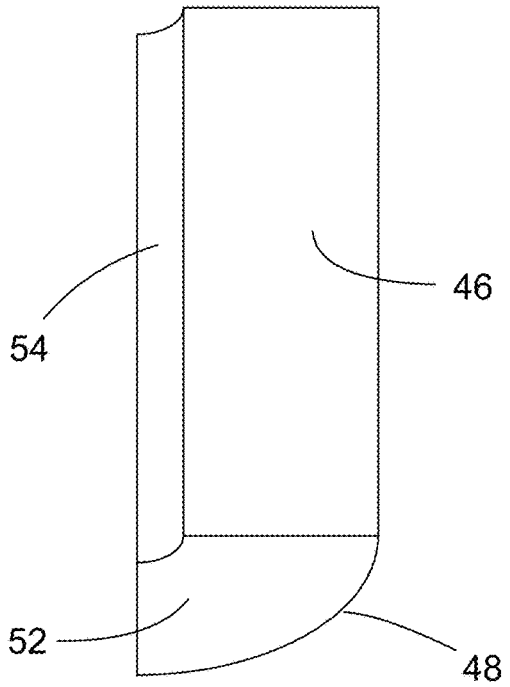
FIG. 5 is a bottom right perspective view of the unitary interior beverage storage vessel 42 introduced in FIG. 3.
Figure 6:
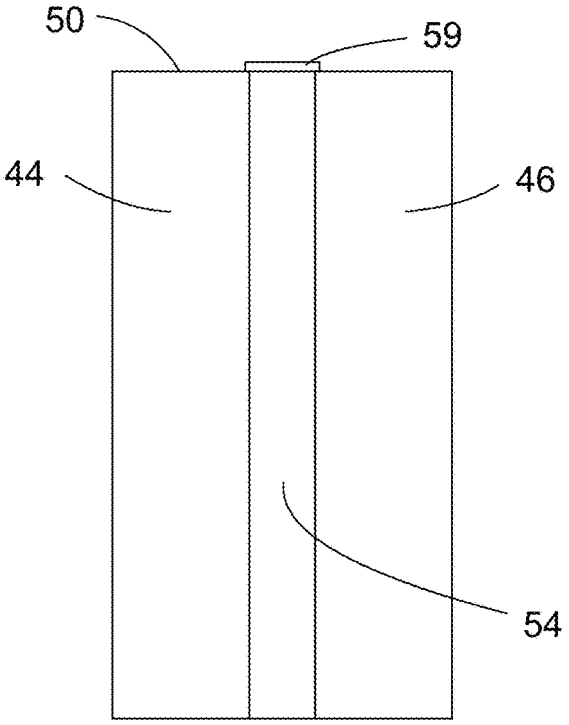
FIG. 6 is a front elevation view of the unitary interior beverage storage vessel 42 introduced in FIG. 3.
Figure 7:
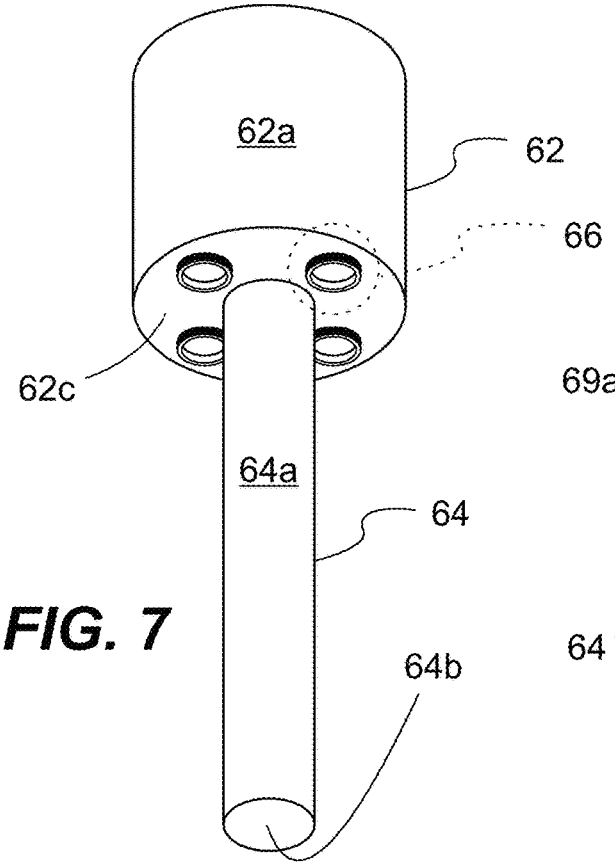
FIG. 7 is a bottom perspective view of a unitary liquid transfer rod 60, in accordance with an exemplary implementation of the present invention.
Figure 8:
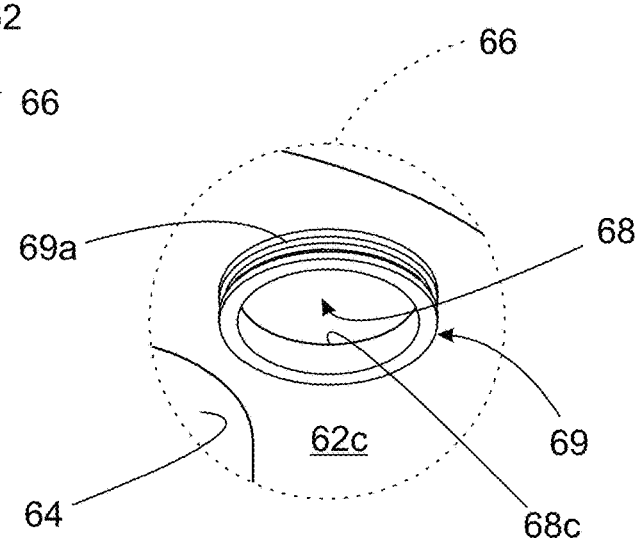
FIG. 8 is an enlarged view of a frictional attachment/engagement structure 66 of the unitary liquid transfer rod 60 introduced in FIG. 7.
Figure 9:
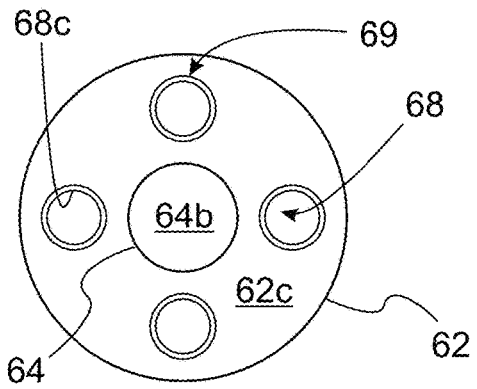
FIG. 9 is a bottom plan view of the unitary liquid transfer rod 60 introduced in FIG. 7.
Figure 10:
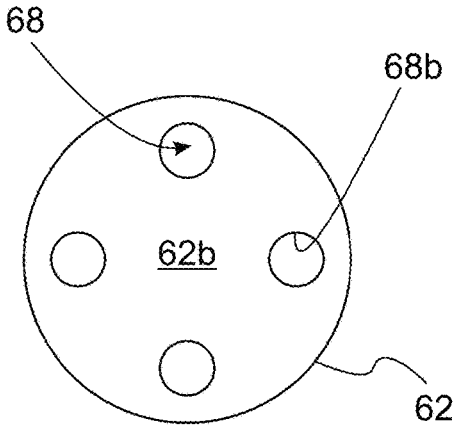
FIG. 10 is a top plan view of the unitary liquid transfer rod 60 introduced in FIG. 7.
Figure 11:
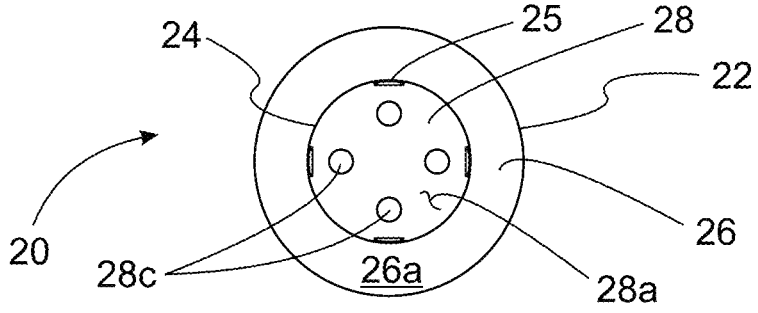
FIG. 11 is a top plan view of an outer container body 20, in accordance with an exemplary implementation of the present invention.
Figure 12:
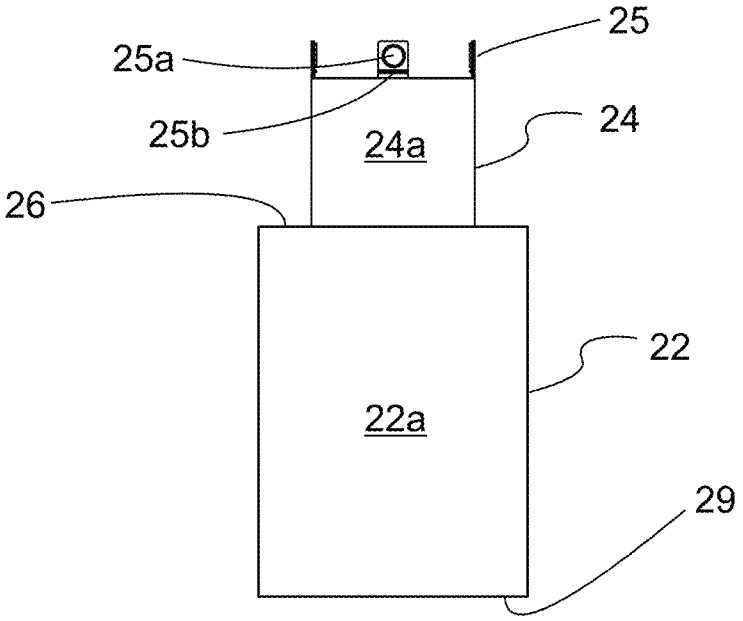
FIG. 12 is a front elevation view of the outer container body 20 introduced in FIG. 11.
Figure 13:
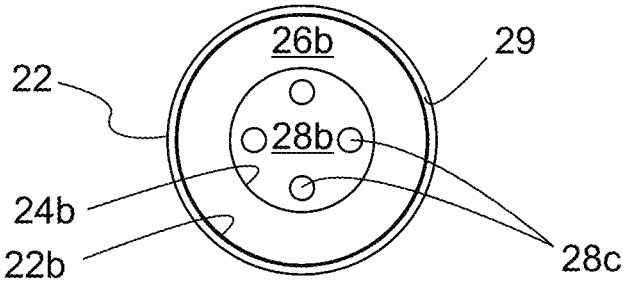
FIG. 13 is a bottom plan view of the outer container body 20 introduced in FIG. 11.

Referring initially to FIGS. 1 and 2, exploded views of the multi-compartment liquid beverage container assembly of the present invention is shown generally as reference number 10. Generally, the multi-compartment liquid beverage container assembly 10 includes an outer container body 20, a plurality of interior beverage storage vessels (shown generally as reference number 40), a liquid transfer rod 60, an outer container body closure cap 70, and (optionally) an auxiliary neck sleeve 80.

Referring now particularly to FIGS. 1, 2 and 11-14, the structure of the outer container body 20 will now be described in more detail. Outer container body 20 includes a main body 22 in the form of a continuous sidewall. Accordingly, this structure is alternatively referred to herein as a "main body," "main body sidewall," and "main body continuous sidewall." Main body 22 extends between outer container shoulder 26 and main body sidewall lower edge 29. Outer container shoulder 26 is further defined by an exterior shoulder surface 26*a* and an opposite interior shoulder surface 26*b*. Main body sidewall 22 is further defined by an exterior surface 22*a* and an interior surface 22*b*. Interior surface 22*b* incorporates a threaded interior surface portion 22*c* proximate to main body sidewall lower edge 29. As described in further detail below, threaded interior surface portion 22*c* enables threaded coupling of closure cap 70 to the bottom of main body 22 of outer container body 20.

At its upper end, outer container body 20 includes a neck 24 in the form of a continuous sidewall. Accordingly, this structure is alternatively referred to herein as a "neck," "neck sidewall," and "neck continuous sidewall." Main body sidewall 22 transitions, via shoulder 26, to neck sidewall 24. Although shoulder 26 is shown having a flat horizontal orientation, it will be apparent to those skilled in the art that the shoulder could alternatively be provided having a straight or curved inward taper. Neck 24 extends between outer container shoulder 26 and neck top wall 28. Neck 24 is further defined by an exterior surface 24*a* and an interior surface 24*b*. Neck exterior surface 24*b* incorporates a threaded exterior surface portion 24*c* proximate to shoulder upper surface 26*a*. As described in further detail below, threaded exterior surface portion 24*c* enables threaded coupling of auxiliary neck sleeve 80 to the lower end of neck 24 of outer container body 20. Neck top wall 28 is further defined by an exterior surface 28*a* and an opposite interior surface 28*b*. Spaced-apart liquid beverage dispensing openings 28*c* are provided extended completely through neck top wall 28. A corresponding plurality of closure tabs 25, each including a fitment nub 25*a* and attached to neck top wall 28 via a living hinge 25*b*, are provided for selectively sealing off the respective liquid beverage dispensing openings 28*c*. Main body 22, shoulder 26, neck 24 and neck top wall 28, together, define an outer container body interior space (generally indicated by reference arrow 30). As described in further detail below, outer container body interior space 30 has a geometry and size particularly suited for close-fitting receipt of unitary liquid transfer rod 60 and interior beverage storage vessels 40, once these components have been subassembled to one another.

Referring now particularly to FIGS. 1-6, the structure of an individual interior liquid beverage storage vessel 42 will now be described. Each interior liquid beverage storage vessel may be defined by: left sidewall 44; right sidewall 46; exterior radial wall 48 adjoining radially exterior, or outer, edges of the left and right sidewalls; upper end wall 50; lower end wall 52; and a concave interior linear groove 54 adjoining radially interior, or inner, edges of the left and right sidewalls. A frictional engagement structure, shown generally as reference numeral 56, is preferably integrated into upper end wall 50. Frictional engagement structure 56 is comprised of opening 58 in upper end wall 50, and raised annular wall feature 59 protruding from the exterior surface of the upper end wall. Preferably, raised annular wall feature 59 bounds, or circumscribes, opening 58. Prior to assembly, an adhesive seal/label (L) or the like may be assembled to annular wall feature 59 in a manner effectively sealing opening 58 to prevent leakage or contamination of any liquid beverage contained within interior liquid beverage storage vessel 42; particularly, during transport and storage. As described in more detail below, the adhesive seal/label (L) is removed during the assembly process.

Referring now particularly to FIGS. 1, 2, and 7-10, the structure of the unitary liquid transfer rod 60 will now be described in more detail. Unitary liquid transfer rod 60 generally includes a thickened upper end 62 having a stem 64 depending linearly downward therefrom. Thickened upper end 62 may be further defined by a cylindrical exterior side surface 62*a* extending between upper surface 62*b* and lower surface 62*c*. As will be apparent to those skilled in the art, the particular cylindrical geometry of the thickened upper end 62 is merely exemplary; alternative geometries could be employed to provide the same functionality without departing from the intended scope of the invention. However, it is important that the cross-sectional geometry of thickened upper end 62 conforms to the corresponding geometry of neck 24. Stem 64 may be further defined by exterior side surface 64*a* and lower end 64*b*.

Significantly, liquid transfer channels 68 are provided extending through thickened upper end 62 of liquid transfer rod 60 for enabling the transfer of liquid beverage from the interior of each interior liquid beverage storage vessel 42 to the corresponding liquid beverage-dispensing openings 28*c* in top wall 28 of neck 24. Each liquid transfer channel 68 extends from an upper transfer channel opening 68*b* in the upper surface 62*b* of thickened upper end 62 to a lower transfer channel opening 68*c* in the lower surface 62*c* of thickened upper end 62. A frictional engagement structure, shown generally as reference numeral 66, is preferably integrated into lower surface 62*c* of thickened upper end 62. Frictional engagement structure 66 is comprised of opening 68*c* in lower surface 62*c*, and raised annular wall feature 69 protruding from lower surface 62*c* of thickened upper end 62 of liquid transfer rod 60. Raised annular wall feature 69—surrounding/bounding, or circumscribing, opening 68*c*—may incorporate a textured (e.g. ribbed) exterior peripheral surface 69*a*. As described in more detail below, during assembly of liquid transfer rod 60 to the interior liquid beverage storage vessels 40 the ribbed exterior peripheral surface 69*a* of each raised annular wall feature 69 frictionally engages the corresponding interior surface 59*a* of the raised annular wall feature 59 of a respective interior liquid beverage storage vessel 42. In this manner, frictional engagement structure 66 of thickened upper end 62 of unitary liquid transfer rod 60, and frictional engagement structure 56 of unitary interior liquid beverage storage vessel 42, define respective upper and lower halves of a first frictional coupling system.

Although not shown in the accompanying drawing figures, it is contemplated to incorporate a similar second frictional coupling system for enabling frictional engagement of the thickened upper end 62 of liquid transfer rod 60 with lower surface 28*b* of top wall 28 of neck 24. For instance, a raised annular wall structure (not shown) similar to raised annular wall feature 69 may be provided surrounding upper channel openings 68*b* of upper surface 62*b* of thickened upper end 62 of liquid transfer rod 60, and a corresponding raised annular wall structure (not shown) similar to annular wall feature 59 may be provided projecting downwardly from interior surface 28*b* of neck top wall 28, and bordering the perimeters of liquid beverage dispensing openings 28*c* in top wall 28 of neck 24.

Figure 14:
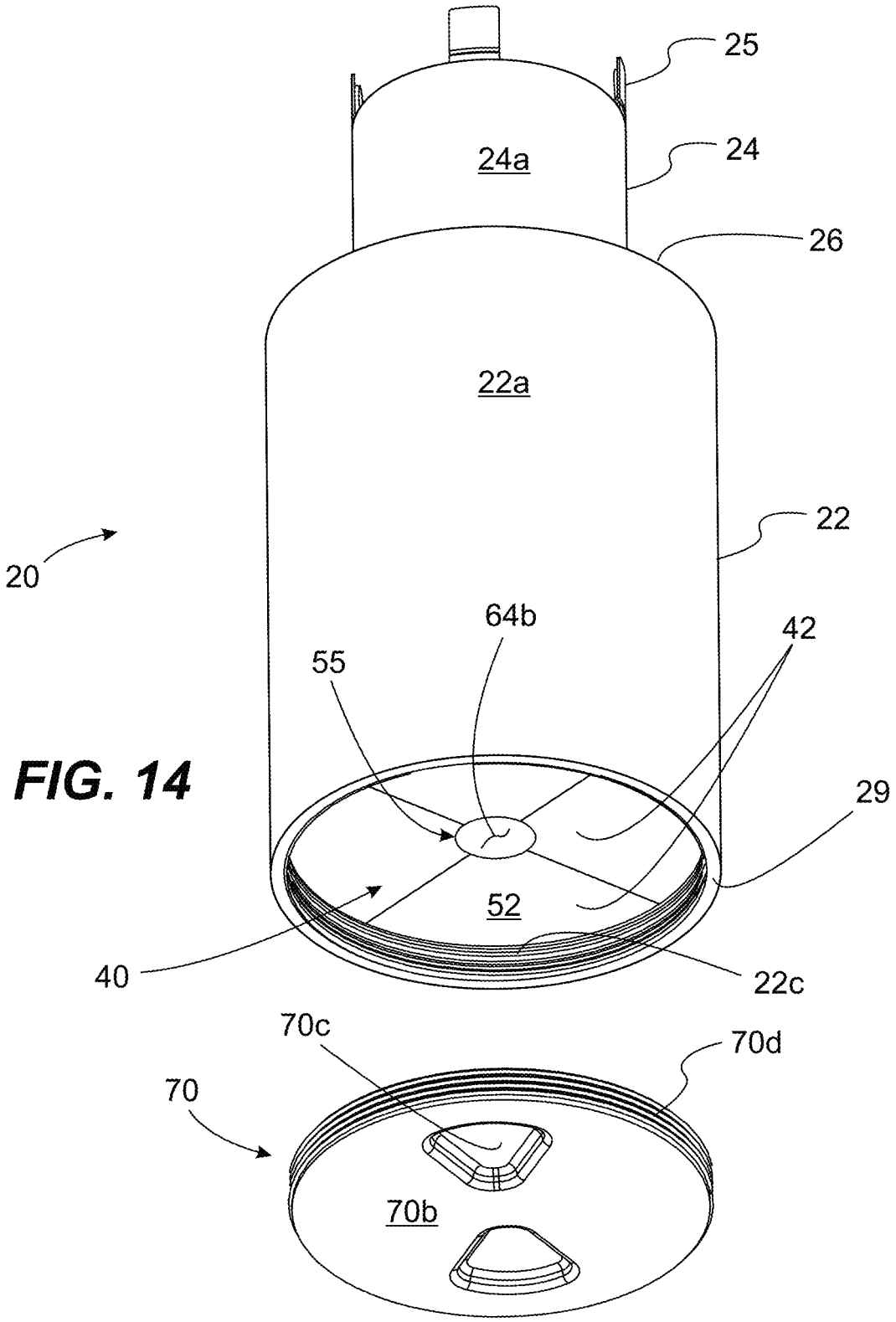
FIG. 14 is a bottom front perspective view of the multi-compartment beverage container subassembly 10 shown in a fully-assembled state, with the closure cap 70 removed to expose the assembled interior storage vessels 40 and liquid transfer rod 60.

Referring now particularly to FIGS. 1, 2 and 14, closure cap 70 is preferably in the form of a circular disk defined by upper surface 70*a*, lower surface 70*b*, and threaded perimeter edge 70*d*. Furthermore, finger gripping features 70*c* may be provided in lower surface 70*b* to aid a user during threading attachment/removal of closure cap 70 to/from threaded lower interior surface portion 22*c* of main body sidewall 22.

Referring now particularly to FIGS. 1 and 2, an optional auxiliary neck sleeve 80 may be releasably attached to neck 24 of outer container body 20 to function as a drinking spout. The auxiliary neck sleeve 80 preferably has a unitary body in the form of a cylindrical sidewall 82 having a lower edge 86 and transitioning at an upper end to a reduced-diameter upper edge 84. The auxiliary neck sleeve 80 (including exterior surface 82*a* and opposite interior surface 82*b*) defines a beverage spout passageway 88 therethrough. A threaded portion 82*c* may be provided along a lower portion of the interior surface 82*b* to enable threading engagement with the threaded portion 24*c* of exterior surface 24*a* of outer container neck 24. The auxiliary neck sleeve 80 functions to combine individual streams of liquid beverage (i.e. flowing through the liquid-dispensing openings 28*c* in top wall 28 of neck 24) into a single combined beverage flow during the act of drinking. At its upper end, auxiliary sleeve 80 may include a drinking spout cap 87 attached thereto via a living hinge 85.

The interior beverage storage vessels 40 are intended to be reusable. Accordingly, it is preferred that they are molded from an appropriate polymer, such as High Density Poly Ethylene (HDPE). With that said, the invention is not intended to be so limited—any suitable alternative materials may be used to construct the interior beverage storage vessels 40 and the outer container body 20, without departing from the intended scope of the invention. A method for assembling multi-compartment beverage container assembly 10 will now be described.

As noted above, prior to assembly, an adhesive seal/label (L) or the like may be assembled to annular wall feature 59 in a manner effectively sealing opening 58 to prevent leakage or contamination of any liquid beverage contained within interior liquid beverage storage vessel 42; particularly, during transport and storage. During the assembly process, the adhesive seal/label (L) is removed to expose opening 58 and annular sidewall 59 of storage vessel 42, and the individual storage vessels 42 are brought together (as generally shown by reference numeral 40) such that the linear grooves 54, together, define a lower stem receiving channel 55 (see FIG. 14). In other words, lower stem receiving channel 55 is formed by adjacent concave interior linear grooves 42 of interior beverage storage vessel subassembly 40.

Subsequently, lower stem 64 of liquid transfer rod 60 is inserted into lower stem receiving channel 55 until frictional engagement structures 66 of thickened upper end 62 of unitary liquid transfer rod 60 frictionally engage corresponding frictional engagement structures 56 of interior liquid beverage storage vessels 42. In this manner, a frictional attachment between thickened upper end 62 and interior beverage storage vessels 42 is formed such that the interiors of the beverage storage vessels are in fluid communication with the corresponding liquid transfer channels 68 extending through thickened upper end 62 of liquid transfer rod 60.

Subsequently, this subassembly of interior liquid beverage storage vessels 42 and liquid transfer rod 60 is inserted into interior space 30 of outer container body 20, such that thickened upper end 62 of liquid transfer rod 60 is seated within an upper interior space of outer container body 20 defined by neck 24 and neck top wall 28, and combined unitary interior beverage storage vessel subassembly 40 is received within a lower interior space of outer container body 20 defined by main body continuous sidewall 22 and shoulder 26. More specifically, upper surface 62*b* of thickened upper portion 62 of liquid transfer rod 60 abuts interior surface 28*b* of neck top wall 28, and cylindrical exterior surface 62*a* of thickened upper end 62 frictionally engages interior surface 24*b* of cylindrical necks sidewall 24. Moreover, the upper surfaces of upper end walls 50 of respective interior liquid beverage storage vessels 42 abut interior surface 26*b* of shoulder 26 of outer container body 20, and the outer surfaces of exterior radial walls 48 frictionally engage interior surface 22*b* of main body sidewall 22 of outer container body 20.

Referring now particularly to FIG. 14, at this point of the assembly process the lower end walls 52 of the sub-assembled interior liquid beverage storage vessels 42 are inset from lower edge 29 of main body sidewall 22 to expose threaded lower interior surface portion 22*c*. Subsequently, outer container body closure cap 70 is attached to the lower end of outer container body 20 via mating of threaded peripheral edge 70*d* of container body closure cap 70 with threaded lower interior surface portion 22*c* of main body sidewall 22. Preferably, closure cap 70 has finger gripping features 70*c* integrated into closure cap exterior surface 70*b* to facilitate user attachment of the closure cap to the outer container body.

Although not shown in the accompany drawings, applicant contemplates incorporating a tamper prevention feature into the multi-compartment liquid beverage assembly 10 to prevent post-assembly removal of interior liquid beverage storage containers 40. By way of example, applicant contemplates incorporating mechanical snap-fit coupling between snap-fit engagement structures 66 of thickened upper end 62 that self-destruct upon detachment of liquid transfer rod 60 from corresponding interior liquid beverage storage containers 40.

Since many modifications, variations, and changes in detail can be made to describe preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A multi-compartment liquid beverage container assembly, comprising:

an outer container body comprising:

a main body transitioning, via a shoulder, to an outer container body neck;

said main body in the form of a continuous sidewall extending between a main body lower edge and said shoulder, the main body defining a main body interior space; and said outer container body neck in the form of a continuous sidewall extending between a container body neck top wall and said shoulder, the outer container body neck defining an outer container body neck interior space, the container body neck top wall having a plurality of apertures extending completely therethrough;

a plurality of interior liquid beverage storage vessels contained within the outer container body;

a unitary liquid transfer rod contained within the outer container body, the unitary liquid transfer rod releasably attached to the plurality of interior beverage storage vessels in a manner enabling the transfer of liquid beverage from the plurality of interior liquid beverage storage vessels to the unitary liquid transfer rod; and a closure cap releasably attachable to a lower end of the outer container body.

2. The multi-compartment liquid beverage container assembly recited in claim 1, wherein the unitary liquid transfer rod further comprises:

a thickened upper end extending vertically between upper and lower surfaces thereof, the thickened upper end having a plurality of liquid transfer channels extending completely therethrough, each one of the plurality of liquid transfer channels extending between an upper opening in the upper surface of the thickened upper end and a lower opening in the lower surface of the thickened upper end, the plurality of liquid transfer channels in alignment with the plurality of container body neck top wall apertures when the multi-compartment liquid beverage container assembly is in a fully-assembled state; and a stem length depending downwardly from the lower surface of the thickened upper end along a central axis of the unitary liquid transfer rod, wherein the thickened upper end of the unitary liquid transfer rod has a geometry and size conforming to the outer container body neck interior space.

3. The multi-compartment liquid beverage container assembly recited in claim 2, wherein the unitary liquid transfer rod further comprises an upper half of a first frictional coupling system in the form of a raised annular wall projecting downwardly from the lower surface of the thickened upper end and surrounding the lower opening in the lower surface of the thickened upper end.

4. The multi-compartment liquid beverage container assembly recited in claim 3, wherein each one of the plurality of interior liquid beverage storage vessels further comprises:

a left sidewall;

a right sidewall;

an upper end wall;

a lower end wall;

an exterior radial wall spanning rear edges of the respective left sidewall, right sidewall, upper end wall and lower end wall; and a concave interior linear groove spanning front edges of the respective left sidewall, right sidewall, upper end wall and lower end wall, wherein the left and right sidewalls, the upper and lower end walls, the exterior radial wall and the concave interior linear groove, together, define an interior space of each one of the interior liquid beverage storage vessels.

5. The multi-compartment liquid beverage container assembly recited in claim 3, wherein each one of the plurality of interior liquid beverage storage vessels further comprises an opening extending completely through the upper end wall.

6. The multi-compartment liquid beverage container assembly recited in claim 5, wherein each one of the plurality of interior liquid beverage storage vessels further comprises a lower half of the first frictional coupling system in the form of a raised annular wall projecting upwardly from an upper surface of the upper end wall and surrounding the opening in the upper end wall, wherein the upper and lower halves of the first frictional coupling system enable releasable frictional attachment of the thickened upper end of the unitary liquid transfer rod to the plurality of interior beverage storage vessels in a manner enabling communication of liquid beverages from each one of the interior beverage storage vessels into respective ones of the plurality of liquid transfer channels.

7. The multi-compartment liquid beverage container assembly recited in claim 6, wherein the plurality of unitary interior beverage storage vessels, together, define a combined geometry and size conforming to the main body interior space of the outer container body.

8. The multi-compartment liquid beverage container assembly recited in claim 7, wherein the concave interior linear grooves of the respective plurality of unitary beverage storage vessels, together, define a liquid transfer rod stem-receiving channel along a central axis of the multi-compartment liquid beverage container assembly, wherein the liquid transfer rod stem-receiving channel conforms to the geometry and size of the liquid transfer rod stem.

9. The multi-compartment liquid beverage container assembly recited in claim 8, wherein the closure cap further comprises:

an upper surface;

a lower surface; and a threaded peripheral edge, wherein the threaded peripheral edge of the closure cap threadingly engages corresponding threads on an interior surface of the continuous sidewall of the lower end of the main body of the outer container body.

10. The multi-compartment liquid beverage container assembly recited in claim 9, wherein the closure cap has a thickness adequate to engage the lower end walls of the plurality of unitary liquid beverage storage vessels such that the corresponding upper end walls of the plurality of unitary liquid beverage storage vessels are urged against an interior surface of the outer container body shoulder, and such that an upper surface of the thickened upper end of the unitary liquid transfer rod is urged against an interior surface of the top wall of the outer container bottle neck.

11. The multi-compartment liquid beverage container assembly recited in claim 1, wherein the container body neck top wall further comprises a plurality of closure tabs attached thereto by respective living hinges, the plurality of closure tabs configured and positioned for selectively sealing the plurality of apertures extending through the container body neck top wall.

12. The multi-compartment liquid beverage container assembly recited in claim 1, further comprising an auxiliary neck sleeve configured for threading engagement with corresponding threads on an exterior surface of the continuous sidewall of the outer container body neck.

* * * * *